US012624933B1

(12) United States Patent
Perzanowski et al.

(10) Patent No.: US 12,624,933 B1
(45) Date of Patent: May 12, 2026

(54) HIGH KINETIC ENERGY HOLLOW BULLET

(71) Applicants: Braeden Michael Perzanowski, Belleville, MI (US); Michael Alan Perzanowski, Gagetown, MI (US); Shaede Stone Perzanowski, Gagetown, MI (US)

(72) Inventors: Braeden Michael Perzanowski, Belleville, MI (US); Michael Alan Perzanowski, Gagetown, MI (US); Shaede Stone Perzanowski, Gagetown, MI (US)

( * ) Notice: Subject to any disclaimer, the term of this patent is extended or adjusted under 35 U.S.C. 154(b) by 0 days.

(21) Appl. No.: 18/810,996

(22) Filed: Aug. 21, 2024

Related U.S. Application Data

(60) Provisional application No. 63/622,342, filed on Jan. 18, 2024.

(51) Int. Cl.
*F42B 12/36* (2006.01)
*F42B 12/06* (2006.01)
*F42B 12/76* (2006.01)

(52) U.S. Cl.
CPC ..... *F42B 12/06* (2013.01); *F42B 12/36* (2013.01); *F42B 12/76* (2013.01)

(58) Field of Classification Search
CPC ..... F42B 10/34; F42B 10/36
See application file for complete search history.

(56) References Cited

U.S. PATENT DOCUMENTS 1,292,388 A * 1/1919 Bowers ..... F42B 10/34 102/508
4,485,742 A * 12/1984 Mamo ..... F42B 5/02 102/503
4,742,774 A * 5/1988 Flatau ..... F42B 10/34 102/501
4,805,535 A * 2/1989 Marcon ..... F42B 7/04 102/439
5,208,424 A 5/1993 Schluckebier et al.
5,275,108 A * 1/1994 Chernicky ..... F42B 10/44 102/501

(Continued)

FOREIGN PATENT DOCUMENTS

CA 2589300 A1 11/2008
CN 107218858 A 9/2017
DE 2806641 A1 * 8/1978 ..... F42B 10/34

*Primary Examiner* — Jonathan C Weber
(74) *Attorney, Agent, or Firm* — John Rizvi; John Rizvi, P.A.—The Patent Professor ®

(57) ABSTRACT

The present invention relates to an innovative hollow bullet design, which fundamentally diverges from conventional solid bullet configurations. This design encompasses a brass casing, gun powder, a plastic wad, and a distinctively structured nozzled projectile. The nozzled projectile features a hollow portion that starts wider at the proximal end and narrows towards the distal end, ingeniously manipulating airflow to enhance kinetic energy during flight. This unique aerodynamic efficiency potentially increases impact force and stability over extended distances. The bullet maintains standard size and weight, ensuring compatibility with existing firearms, and offers significant improvements in performance for both civilian and military applications.

20 Claims, 5 Drawing Sheets

(56) References Cited

U.S. PATENT DOCUMENTS

| | | | | |
|---|---|---|---|---|
| 5,275,110 | A * | 1/1994 | Flatau | F42B 30/02 102/509 |
| 5,515,787 | A * | 5/1996 | Middleton | F42B 12/34 102/521 |
| 5,943,749 | A | 8/1999 | Swank | |
| 6,546,875 | B2 | 4/2003 | Vaughn et al. | |
| 9,316,468 | B2 | 4/2016 | Rall et al. | |
| 2005/0257413 | A1* | 11/2005 | Zimmermann | F42B 5/025 42/75.1 |
| 2006/0144280 | A1 | 7/2006 | Hirt et al. | |
| 2020/0182596 | A1 | 6/2020 | Masinelli et al. | |
| 2022/0178663 | A1* | 6/2022 | Caudle | F42B 10/34 |

* cited by examiner

HIGH KINETIC ENERGY HOLLOW BULLET

CROSS-REFERENCE TO RELATED APPLICATIONS

This application claims the benefit of U.S. Provisional Patent Application Ser. No. 63/622,342, filed on Jan. 18, 2024, which is incorporated by reference herein in its entirety.

FIELD OF THE INVENTION

The present invention relates generally to the field of ammunition and, more specifically, to bullet design. It concerns the development of a hollow bullet with a unique structure that enhances kinetic energy output through an innovative nozzled projectile configuration.

BACKGROUND OF THE INVENTION

The field of ammunition, specifically bullet design, has a rich history characterized by constant innovation and adaptation to evolving requirements in both military and civilian contexts. Traditional bullet designs have primarily focused on solid projectiles, where the mass, material composition, and aerodynamic shape are critical in determining the bullet's performance characteristics, such as velocity, trajectory, stability, and impact force. The evolution of bullet design reflects a balance between these performance attributes and the practical considerations of manufacturing, standardization, and compatibility with firearms.

Historically, the earliest bullets were simple round lead balls used in muskets, which later evolved into more aerodynamic shapes with the advent of rifled barrels. The Minie ball, a conical bullet with a hollow base, introduced in the mid-19th century, represented a significant advancement, improving range and accuracy. This evolution continued with the development of the modern bullet, typically comprising a lead core and a copper or brass jacket, which offered improved consistency and performance.

One of the central challenges in bullet design has been enhancing the kinetic energy and terminal performance without significantly increasing the size or weight of the bullet. Kinetic energy, a critical factor in a bullet's effectiveness, is a function of both the mass and the velocity squared of the bullet. Designers have traditionally approached this challenge by either increasing the bullet's mass or its velocity. However, each approach has limitations. Increasing mass can result in greater recoil and reduced magazine capacity, while higher velocities can lead to increased barrel wear and reduced accuracy due to greater aerodynamic resistance.

Aerodynamics plays a crucial role in bullet design. The shape of the bullet must be optimized to reduce air resistance, maintain stability in flight, and ensure accuracy. The most common bullet shapes include the round nose, the flat nose, and the spitzer, which is a pointed bullet design that offers superior aerodynamic efficiency. These shapes are designed to balance the need for aerodynamic efficiency with other performance factors, such as terminal ballistics, which is how the bullet behaves upon impact with the target.

The introduction of jacketed bullets, where a harder metal jacket encases a softer core, marked a significant advancement in bullet technology. These bullets offered improved barrel life, better penetration, and more consistent performance. The full metal jacket (FMJ) bullets, in particular, became a standard in military applications due to their reliability and adherence to international conventions regarding the use of expanding or fragmenting ammunition in warfare.

Despite these advancements, conventional solid bullet designs have inherent limitations in terms of aerodynamics and energy efficiency during flight. The interaction between the bullet and the air through which it travels can lead to a loss of velocity and stability over distance, affecting both accuracy and impact force. Designers have explored various approaches to mitigate these issues, such as boat-tailing, where the rear of the bullet is tapered to reduce air turbulence and drag.

In addition to aerodynamic considerations, the internal ballistics of how the bullet behaves within the barrel of the firearm is a critical aspect of design. Factors such as the bullet's interaction with the rifling, the pressure and temperature dynamics within the barrel, and the efficiency of the propellant all play a role in the ultimate performance of the bullet. The design of the bullet must be compatible with these internal ballistic factors to ensure optimal performance.

Another significant aspect of bullet design is terminal ballistics, which concerns the behavior of the bullet upon impact with the target. The design must balance the need for penetration with the desire to transfer kinetic energy to the target efficiently. Various designs, such as hollow-point bullets, which expand upon impact to create a larger wound channel, have been developed for specific applications where rapid energy transfer is desirable.

Manufacturing considerations also play a vital role in bullet design. The materials used, the complexity of the design, and the compatibility with existing firearms and manufacturing processes are all factors that influence the feasibility and practicality of a bullet design. Innovations in materials science, such as the use of polymer tips or advanced metal alloys, have opened new avenues for bullet design, offering improved performance characteristics while maintaining manufacturability.

Environmental and health concerns have also influenced bullet design in recent years. The use of lead in bullets has come under scrutiny due to its toxic effects on both humans and wildlife. This has led to the development of lead-free bullets, which use alternative materials such as copper or tungsten to achieve similar performance characteristics without the environmental and health risks associated with lead.

In summary, bullet design is a complex and evolving field that demands constant innovation to meet changing requirements and overcome existing limitations. Despite the significant advancements in materials, manufacturing processes, and an in-depth understanding of ballistics, traditional solid bullet designs face intrinsic challenges, particularly in terms of optimizing aerodynamics and kinetic energy. This has led to a recognized need in the industry for novel bullet configurations that can offer enhanced aerodynamic efficiency and energy optimization while maintaining or improving other critical performance factors like accuracy, stability, and terminal ballistics. The ongoing quest for advanced bullet performance underscores the necessity for innovative approaches that can transcend the limitations of conventional designs, thereby setting new standards in bullet technology and offering potential advantages in both civilian and military applications. This need for innovation reflects the industry's continual pursuit of technological advancement, balancing the intricate interplay of physics, materials science, and engineering with practical and strategic considerations inherent in ammunition design.

SUMMARY OF THE INVENTION

The present invention introduces a novel hollow bullet design, significantly diverging from traditional solid bullet configurations. It comprises an entire shell consisting of a primer cap, a brass casing, gun powder, a plastic wad, and a distinctively structured nozzled projectile. The innovative aspect of this design is the nozzled projectile, featuring a hollow portion that begins large at the proximal end and progressively narrows and tapers towards the distal end. This unique internal configuration is designed to harness and manipulate airflow through the bullet during flight, aiming to fundamentally enhance its kinetic energy output while maintaining the standard dimensions and weight common to conventional ammunition.

The benefits of this invention over prior art are multifaceted. Firstly, the hollow, tapered design of the projectile allows for a novel mechanism of air compression and expulsion, theorized to significantly increase the bullet's kinetic energy during flight. This increase in kinetic energy could translate into higher impact force upon reaching the target, a crucial factor in both military and civilian applications. Secondly, the aerodynamic efficiency is expected to be superior to that of traditional solid bullets. The internal airflow dynamics within the bullet could lead to enhanced stability and accuracy over longer distances, addressing a common limitation in existing designs. Additionally, this innovative configuration is achieved without altering the standard size and weight parameters of the bullet, ensuring compatibility with existing firearms and ammunition manufacturing processes. This aspect is particularly advantageous as it offers an upgrade in performance without the need for modifications in the broader firearm ecosystem. Overall, the invention presents a groundbreaking approach in bullet design, potentially setting new performance standards while aligning with current manufacturing and operational practices.

In a first implementation of the invention, a bullet comprises:

- a casing;
- a wad disposed within the casing;
- a nozzled projectile operatively coupled to the wad; wherein the nozzled projectile is hollow and includes an internal tapered structure extending longitudinally from a proximal end to a distal, and further wherein the internal tapered structure is configured to facilitate airflow during flight of the bullet, thereby enhancing the kinetic energy of the bullet.

In a second aspect, wherein the casing may be made of brass.

In another aspect, the bullet may further comprise a primer cap configured to ignite gun powder within the case.

In another aspect, wherein the primer cap may be positioned at an end of the casing opposite the nozzled projectile.

In another aspect, wherein the wad may be made of plastic.

In another aspect, wherein the nozzled projectile may be made of a metal alloy.

In another aspect, wherein the diameter at the proximal end of the nozzled projectile's internal tapered structure may be at least twice the diameter at the distal end.

In another aspect, wherein the internal tapered structure of the nozzled projectile may be configured to create a venturi effect during flight.

In another aspect, wherein the nozzled projectile may include an exterior shape that is aerodynamically optimized.

In another aspect, wherein the casing may contain gun powder.

In another aspect, wherein the gun powder may be a smokeless powder.

In another aspect, wherein the nozzled projectile may further comprise an external ballistic tip at the distal end.

In another aspect, wherein the internal tapered structure of the nozzled projectile may provide stabilization during flight.

In another aspect, wherein the nozzled projectile may be configured to fit standard firearm calibers.

In another aspect, wherein the wad may be configured to seal gases from the ignited gun powder and direct them towards the nozzled projectile.

In another aspect, wherein the nozzled projectile may include an internal structure that aids in fragmentation upon impact.

In another aspect, wherein the nozzled projectile may be coated with a lubricant to reduce barrel wear.

In another aspect, wherein the bullet may be compatible with rifled barrels.

In another aspect, wherein the nozzled projectile's distal end may be designed to maximize penetration upon impact.

In another aspect, wherein the bullet may be designed for use in both civilian and military applications.

In another aspect, wherein the nozzled projectile may include a material composition that reduces environmental impact.

In another implementation of the invention, a bullet comprises:

- an adjustable nylon strap capable of looping over a patient's extremity, where the strap includes a series of adjustable loops or notches for length adjustment and a locking mechanism for securing the desired length;
- a brass casing containing a specific type of smokeless gun powder;
- a plastic wad disposed within the brass casing and positioned adjacent to the smokeless gun powder; and
- a nozzled projectile operatively coupled to the plastic wad, wherein:
  - i. the nozzled projectile is hollow and includes an internal tapered structure made of a metal alloy, extending longitudinally from a proximal end to a distal end, with the diameter at the proximal end being at least twice the diameter at the distal end;
  - ii. the internal tapered structure is configured to create a venturi effect during flight of the bullet to enhance kinetic energy and stability;
  - iii. the nozzled projectile further includes an exterior aerodynamically optimized shape and an external ballistic tip at the distal end for maximized penetration upon impact.

In another implementation of the invention, a method of operating a hollow bullet comprises the steps of:

a. loading the bullet into a firearm, wherein the bullet includes a brass casing containing smokeless gun powder, a plastic wad, and a nozzled projectile with an internal tapered structure made of a metal alloy;
b. firing the bullet from the firearm, wherein the ignition of the smokeless gun powder by a firing mechanism causes a rapid expansion of gases within the brass casing;
c. propelling the nozzled projectile through the barrel of the firearm, wherein the plastic wad seals the gases and directs them towards the nozzled projectile;
d. allowing air to enter the hollow nozzled projectile at the proximal end and pass through the internal tapered structure, creating a venturi effect that enhances the kinetic energy and stability of the bullet during flight;

e. maintaining the bullet's trajectory and stability through the aerodynamically optimized shape of the nozzled projectile; and f. achieving maximized penetration upon impact with the target, facilitated by the external ballistic tip at the distal end of the nozzled projectile.

In another aspect, wherein the step of firing the bullet from the firearm may include utilizing a rifle with a rifled barrel to achieve enhanced accuracy and stability in the bullet's flight.

In another aspect, the method may further comprise the step of coating the nozzled projectile with a lubricant prior to firing to reduce wear on the firearm's barrel.

In another aspect, wherein the step of propelling the nozzled projectile through the barrel of the firearm may include achieving a specific muzzle velocity that optimizes the venturi effect created within the nozzled projectile.

In another aspect, the bullet may further comprise the step of selecting a firearm compatible with the specific caliber and dimensions of the nozzled projectile to ensure proper functioning and performance.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 5:
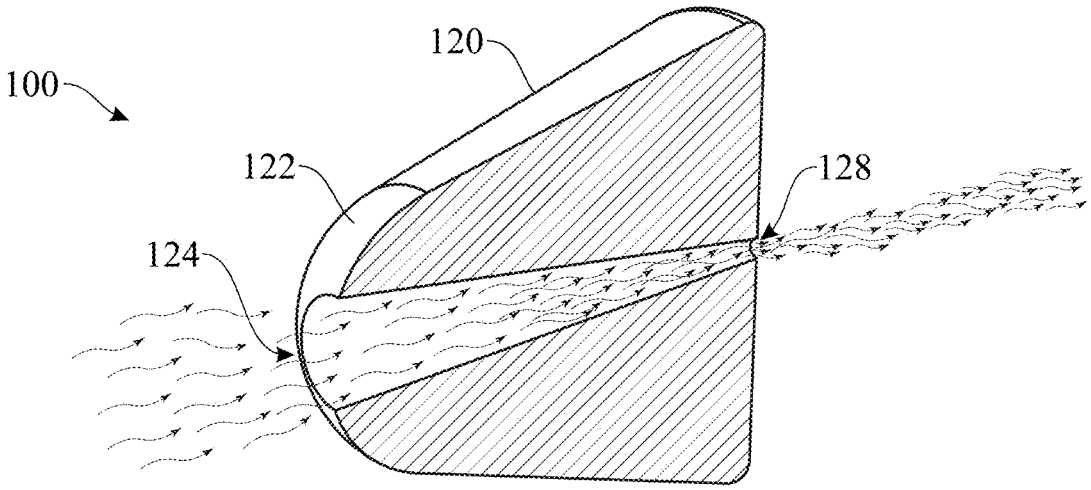
FIG. 5 presents a cross-sectional side view of the nozzled projectile of hollow bullet illustrated in FIG. 1, shown from the proximal end to the distal end revealing the internal structure and arrangement of components, as well as the air flow within the hollow bullet.

Shown through FIGS. 1-10, the present invention introduces a novel hollow bullet 100 design, which marks a significant shift from traditional solid bullet configurations. This bullet 100 comprises several integral components: a primer cap 104, a brass casing 108, gun powder 112, a plastic wad 116, and a uniquely structured nozzled projectile 120. The inventive aspect of this design lies primarily in the nozzled projectile 120, featuring a hollow portion that commences with a larger diameter at the proximal end 124 and gradually tapers to a smaller diameter towards the distal end 128. As depicted in FIG. 5, this internal configuration is ingeniously designed to manipulate airflow through the bullet during flight, thereby aiming to substantially enhance its kinetic energy output while adhering to the standard dimensions and weight typical of conventional ammunition.

Figure 1:
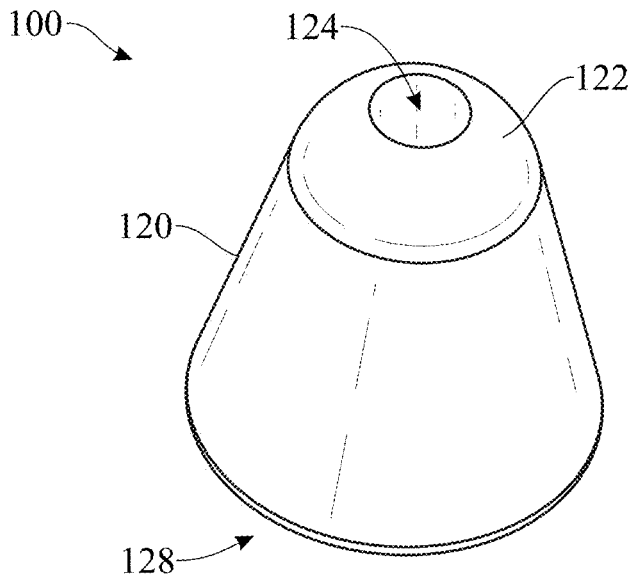
FIG. 1 presents a front perspective view of a nozzled projectile of the hollow bullet, in accordance with a first illustrative embodiment of the present invention, shown with particular focus on its external appearance and contour.

FIG. 1 provides a front perspective view of the nozzled projectile 120, showcasing its external appearance and contour that have been optimized for aerodynamics. This perspective emphasizes the projectile's sleek design, which is meticulously tailored for aerodynamic efficiency. The view underlines how each curve and contour of the projectile is shaped to minimize air resistance, thereby enhancing the bullet's velocity and trajectory.

Figure 2:
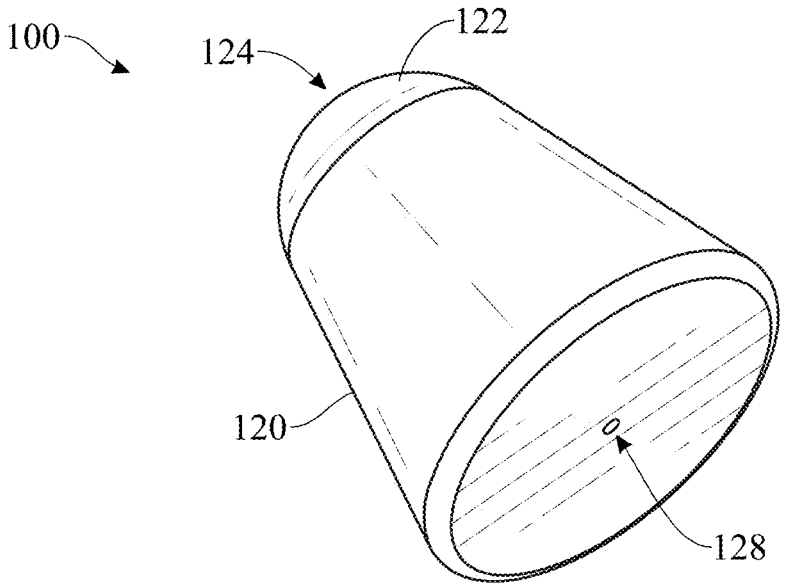
FIG. 2 presents a rear perspective view the nozzled projectile of the hollow bullet illustrated in FIG. 1, highlighting the design and features of the back end.
Figure 3:
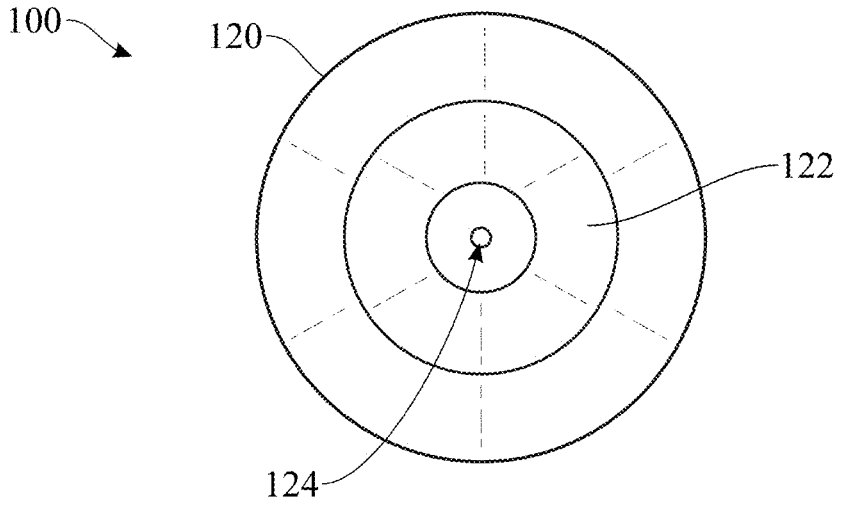
FIG. 3 presents a top plan view of the hollow bullet illustrated in FIG. 1.
Figure 4:
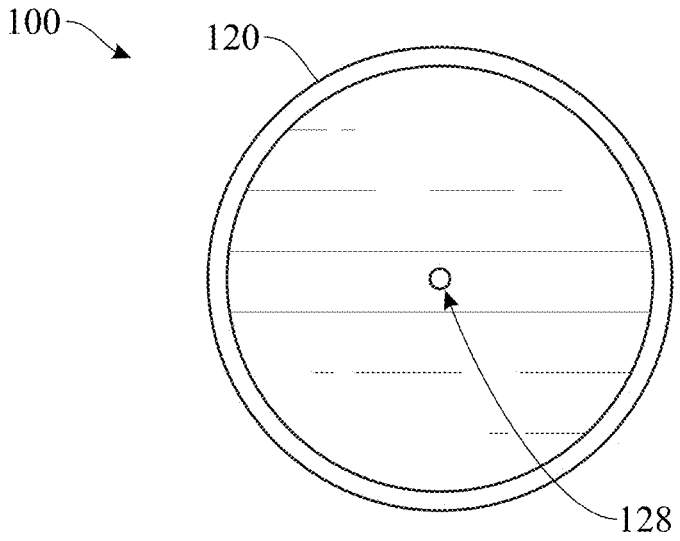
FIG. 4 presents a bottom plan view of hollow bullet illustrated in FIG. 1.

Contrastingly, FIG. 2 offers a rear perspective view of the nozzled projectile 120. This view highlights the intricate design elements at the bullet's rear, which play a pivotal role in its alignment and propulsion when fired from a firearm. The design considerations evident in this view are critical for the bullet's performance, ensuring that upon ignition, the bullet is propelled forward with maximum efficiency and minimal loss of energy.

Figure 7:
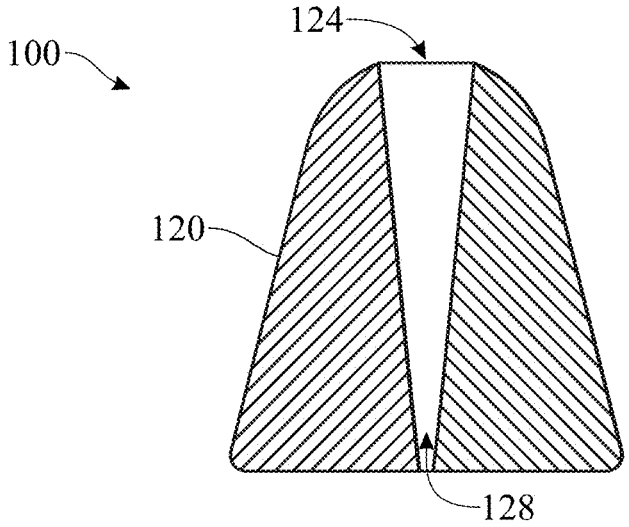
FIG. 7 presents a cross-sectional view of the nozzled projectile of hollow bullet illustrated in FIG. 1, shown from the distal end to the proximal end revealing the internal air flow within the hollow bullet.
Figure 8:
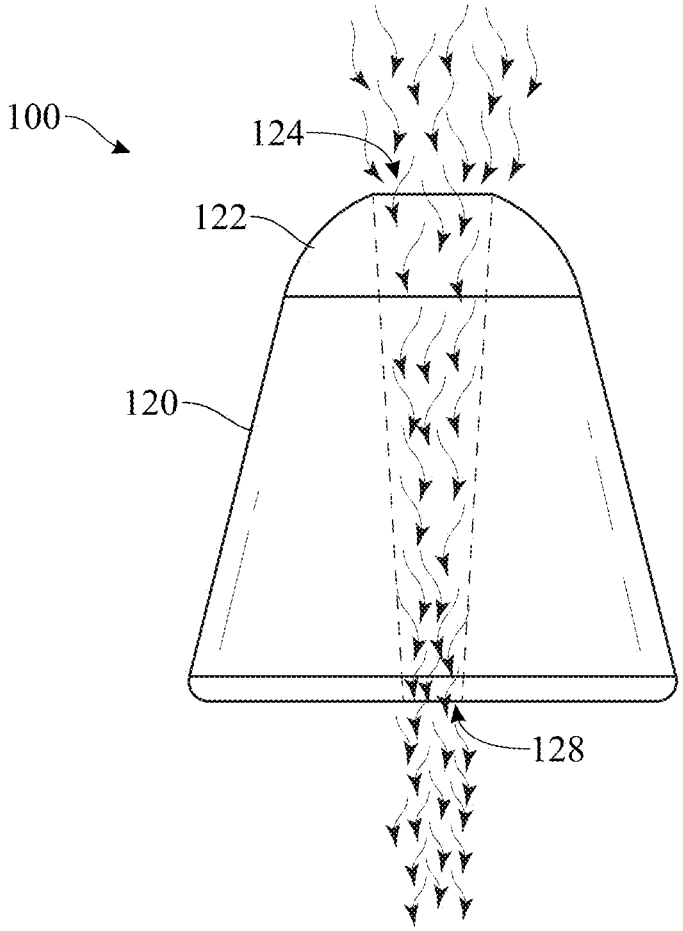
FIG. 8 presents a cross-sectional view of the hollow bullet illustrated in FIG. 7, shown from the distal end to the proximal end revealing the internal structure and arrangement of components.

The design of the projectile 120, as further elucidated in FIG. 7 through a cross-sectional view, incorporates a hollow, tapered structure that fosters a unique mechanism of air compression and expulsion. This mechanism is theorized to considerably augment the bullet's kinetic energy during its flight. The increase in kinetic energy, as visualized in this figure, is expected to translate into a higher impact force upon reaching the target, an attribute that is highly desirable in both military and civilian applications.

As shown throughout the figures, the hollow bullet 100 design includes an upper portion 122 of the nozzled projectile 120 that is integral to the bullet's aerodynamic performance. This segment, located near the proximal end 124 is wider in diameter, allowing substantial air entry into the hollow structure. The configuration of 122 is vital for initiating the air compression within the bullet, a mechanism crucial for enhancing kinetic energy and flight stability. Its design ensures that the bullet 100 achieves optimal aerodynamics and impact force, underscoring the importance of the upper portion 122 in the overall functionality of the nozzled projectile 120.

Figure 6:
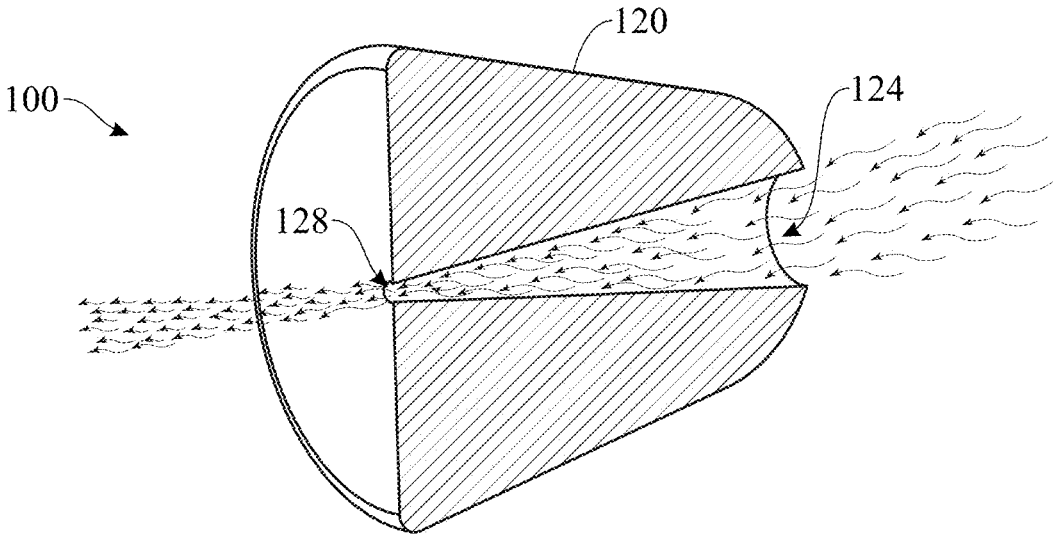
FIG. 6 presents a cross-sectional side view of the nozzled projectile of the hollow bullet illustrated in FIG. 1, shown from the distal end to the proximal end revealing the internal structure and arrangement of components, as well as the air flow within the hollow bullet.

In addition to the external and internal design features, FIG. 6 presents a cross-sectional side view from the distal end 128 to the proximal end 124, revealing the bullet's internal structure and airflow dynamics. This view is instrumental in understanding how air flows through the bullet, impacting its stability and accuracy over extended distances.

Figure 9:
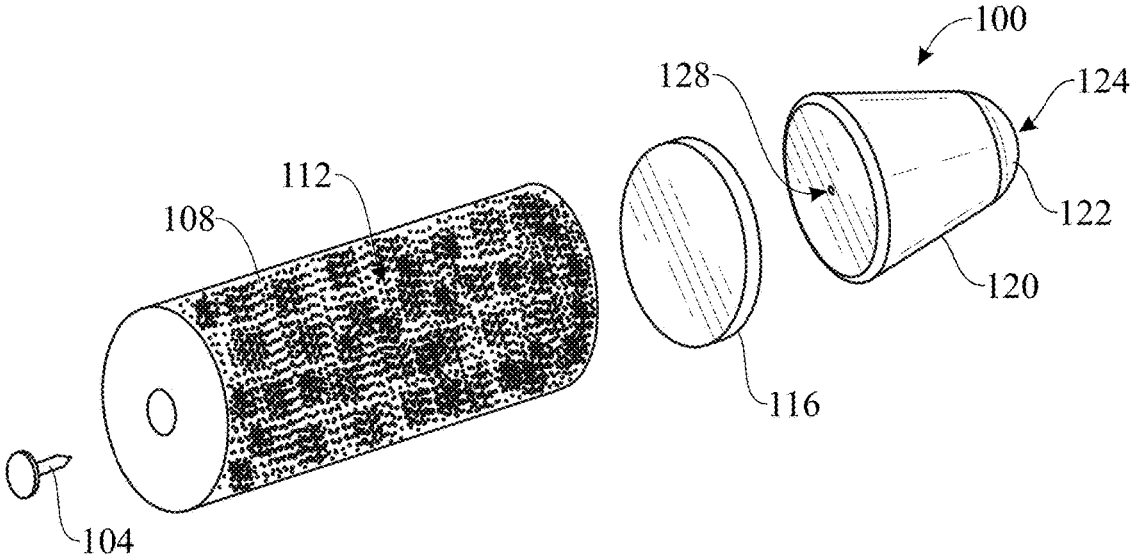
FIG. 9 presents an exploded view of an entire shell of the hollow bullet, illustrating the individual components including gun powder, plastic wad, and primer cap in relation to each other.
Figure 10:
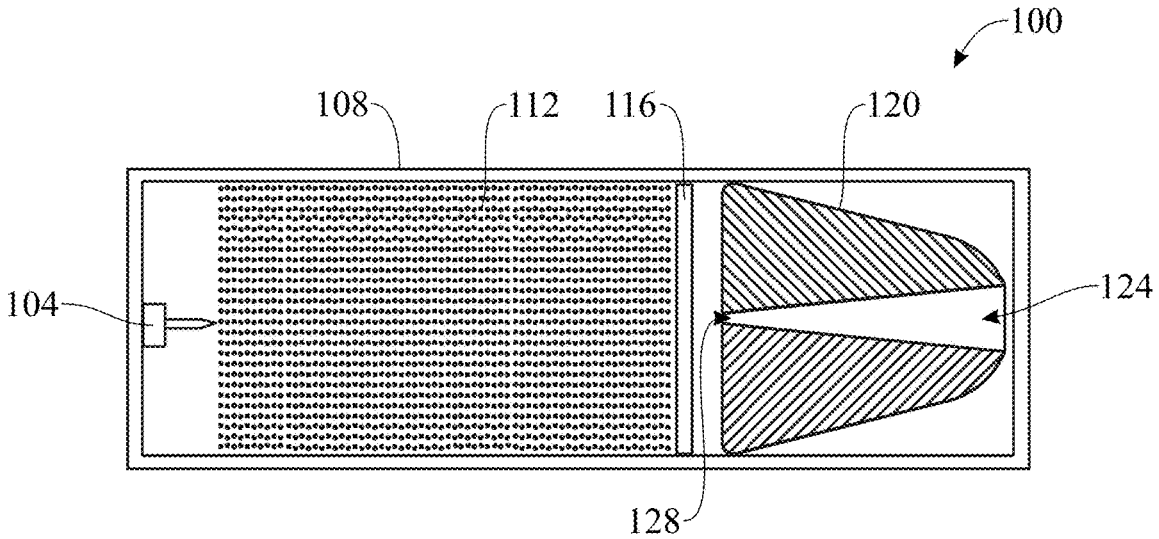
FIG. 10 presents an exploded view of an entire shell of the hollow bullet, illustrating the individual components including gun powder, plastic wad, and primer cap in relation to each other; and Like reference numerals refer to like parts throughout the several views of the drawings.

Delving deeper into the components, as illustrated in the exploded views of FIGS. 9 and 10, the bullet includes a brass casing 108 that contains a specific type of smokeless gun powder 112. This gun powder is carefully chosen for its combustion properties, ensuring that it provides the requisite propulsion force while maintaining the structural integrity of the bullet. Located adjacent to the gun powder 112 within the brass casing 108 is a plastic wad 116, which serves multiple functions, including sealing the gun powder and providing a base for the nozzled projectile 120.

The nozzled projectile 120, operatively linked to the plastic wad 116, is fabricated from a durable metal alloy. This material choice is pivotal for ensuring that the projectile withstands the immense forces exerted upon firing. The internal tapered structure of the nozzled projectile 120 extends longitudinally from the proximal end 124 to the distal end 128. The diameter at the proximal end 124 is deliberately designed to be at least twice the diameter at the distal end 128. This specific tapering is not arbitrary; it is a calculated design decision aimed at creating a venturi effect during the bullet's flight. The venturi effect, a phenomenon where a fluid's velocity increases as it passes through a constricted section of a pipe, in this case, enhances both the kinetic energy and stability of the bullet.

The operation of the hollow bullet 100, as demonstrated in FIG. 10, includes several steps. Initially, the bullet is loaded into a firearm. This process is crucial as it involves correctly positioning the bullet to ensure that upon ignition, the gun powder 112 is efficiently ignited. The brass casing 108, housing the smokeless gun powder 112, the plastic wad 116, and the nozzled projectile 120 with its internal tapered structure, are all critical at this stage. Once the firearm is discharged, the ignition of the smokeless gun powder 112 by the firing mechanism leads to a rapid expansion of gases within the brass casing 108. This expansion propels the nozzled projectile 120 through the barrel of the firearm. During this process, the plastic wad 116 plays a significant role in sealing the gases and directing them towards the nozzled projectile 120. This step is crucial for ensuring that the projectile receives the maximum possible propulsion force.

As the bullet travels through the barrel and exits the firearm, air enters the hollow nozzled projectile 120 at the proximal end 124. This air then moves through the internal tapered structure, where the venturi effect comes into play, significantly amplifying the kinetic energy and stability of the bullet during its flight. This aspect of the bullet's operation is critical for achieving the desired trajectory and impact force. The bullet's trajectory and stability are further maintained through the aerodynamically optimized shape of the nozzled projectile 120. This shape, as highlighted in FIG. 1, is not only about aesthetic appeal but is fundamentally about enhancing the bullet's performance.

Concluding the bullet's journey, the external ballistic tip at the distal end 128 of the nozzled projectile 120, as shown in FIG. 2, facilitates maximized penetration upon impact. This feature is particularly important in contexts where the bullet is expected to penetrate hard surfaces or armor. The design of the ballistic tip is such that it aids in the bullet retaining its structural integrity upon impact, ensuring that the energy is efficiently transferred to the target.

The nozzled projectile 120, as detailed across the various figures, is meticulously designed to fit standard firearm calibers. This compatibility is essential for ensuring that the bullet can be widely adopted without necessitating changes to existing firearms. The internal structure of the nozzled projectile 120, particularly the tapered hollow portion, plays a vital role in augmenting the bullet's aerodynamic performance and stability during flight. This enhancement is evident in the cross-sectional views provided in FIGS. 5 and 6, where the airflow and internal dynamics of the bullet are clearly visible.

In terms of environmental considerations, the bullet's composition includes materials that mitigate its environmental impact. This factor is increasingly important in the context of global environmental concerns and the need for sustainable practices in all industries, including ammunition manufacturing.

Alternate embodiments of the present invention, reference numeral 100, a hollow bullet design, offer variations in design and functionality while maintaining the core inventive concept. These embodiments provide flexibility in application and broaden the scope of the invention's utility in various contexts.

In one alternate embodiment, the nozzled projectile 120 may be constructed with varying materials to suit different operational needs. For instance, the use of advanced composite materials or high-strength polymers could be employed to reduce the overall weight of the bullet, thereby enhancing its velocity and range. This embodiment would be particularly advantageous in situations where long-range accuracy is paramount. Furthermore, the internal tapered structure of the nozzled projectile 120 could be modified to have different tapering ratios or shapes, potentially altering the airflow dynamics to optimize for specific flight characteristics, such as increased stability or reduced drag. This variation in the internal structure could allow for fine-tuning the bullet's performance based on the intended use, be it for sporting activities, hunting, or military operations.

Another embodiment might involve variations in the brass casing 108 and the primer cap 104. For example, the brass casing 108 could be replaced with a casing made of a different metal or metal alloy, offering benefits such as reduced cost, increased casing strength, or compatibility with different types of firearms. The primer cap 104 could be designed with alternative ignition mechanisms, possibly incorporating electronic firing systems for increased reliability and precision. Such adaptations would be beneficial in environments where traditional percussion-based firing mechanisms are less desirable, such as in highly controlled or sensitive shooting conditions.

Moreover, the gun powder 112 within the bullet could be an alternate type, such as a more environmentally friendly propellant or one that produces less residue upon firing, thereby reducing cleaning and maintenance requirements for the firearm. This alternative could appeal to users who are environmentally conscious or those who require minimal maintenance efforts.

In addition to these variations, the plastic wad 116 could be designed to serve additional functions, such as delivering payloads like tracers, incendiaries, or even non-lethal options for crowd control or training purposes. This versatility would significantly expand the utility of the bullet design beyond traditional applications.

These alternate embodiments illustrate the versatility and adaptability of the hollow bullet design. By offering various configurations and material options, the invention can be tailored to meet a wide range of requirements, making it a valuable addition to the field of ammunition technology.

In summation, the hollow bullet 100, as thoroughly described and illustrated across FIGS. 1 through 10, represents a significant advancement in ammunition technology. Its innovative design, which leverages aerodynamic principles, is set to elevate performance, a crucial factor in modern firearms applications. This novel approach in bullet design has the potential to redefine performance standards in the ammunition industry while aligning with current manufacturing and operational practices.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A bullet comprising:

a casing;

a wad disposed within the casing;

a nozzled projectile operatively coupled to the wad; wherein the nozzled projectile is hollow and includes an internal tapered structure extending longitudinally from a proximal end which is a tip to a distal end, and further wherein the internal tapered structure is configured to facilitate airflow during flight of the bullet, thereby enhancing the kinetic energy of the bullet, and wherein the nozzled projectile has a point located adjacent to the proximal end which is wider in diameter than the proximal end, and wherein the nozzled projectile widens in diameter and is conically shaped from the point adjacent the proximal end to the distal end.

2. The bullet of claim 1, wherein the casing is made of brass.

3. The bullet of claim 1 wherein the bullet further comprises a primer cap configured to ignite gun powder within the casing.

4. The bullet of claim 3, wherein the primer cap is positioned at an end of the casing opposite the nozzled projectile.

5. The bullet of claim 1, wherein the wad is made of plastic.

6. The bullet of claim 1, wherein the nozzled projectile is made of a metal alloy.

7. The bullet of claim 1, wherein, a diameter at the proximal end of the nozzled projectile's internal tapered structure is at least twice a diameter at the distal end.

8. The bullet of claim 1, wherein the internal tapered structure of the nozzled projectile is configured to create a venturi effect during flight.

9. The bullet of claim 1, wherein the nozzled projectile includes an exterior shape that is aerodynamically optimized.

10. The bullet of claim 1, wherein the casing contains gun powder.

11. The bullet of claim 1, wherein the gun powder is a smokeless powder.

12. The bullet of claim 1, wherein the nozzled projectile further comprises an external ballistic tip at the distal end.

13. The bullet of claim 1, wherein, the internal tapered structure of the nozzled projectile is configured to provide stabilization during flight.

14. The bullet of claim 1, wherein the wad is configured to seal gases from the ignited gun powder and direct them towards the nozzled projectile.

15. The bullet of claim 1, wherein the nozzled projectile includes an internal structure that aids in fragmentation upon impact.

16. The bullet of claim 1, wherein the nozzled projectile is coated with a lubricant.

17. The bullet of claim 1, wherein, the nozzled projectile's distal end is configured to maximize penetration upon impact.

18. A bullet which comprises:

a brass casing containing smokeless gun powder;

a plastic wad disposed within the brass casing and positioned adjacent to the smokeless gun powder; and a nozzled projectile operatively coupled to the plastic wad, and wherein:

iii. the nozzled projectile is hollow and includes an internal tapered structure made of a metal alloy, extending longitudinally from a proximal end to a distal end, with the diameter at the proximal end being at least twice a diameter at the distal end;

ii. the internal tapered structure is configured to create a venturi effect during flight of the bullet to enhance kinetic energy and stability;

iii. the nozzled projectile further includes an exterior aerodynamically optimized shape and an external ballistic tip at the distal end for maximized penetration upon impact, and wherein the nozzled projectile has a point located adjacent to the proximal end which is wider in diameter than the proximal end, and wherein the nozzled projectile widens in diameter and is conically shaped from the point adjacent the proximal end to the distal end.

19. A method of operating a hollow bullet comprising the steps of:

a. loading a bullet into a firearm, wherein the bullet includes a brass casing containing smokeless gun powder, a plastic wad, and a nozzled projectile with an internal tapered structure made of a metal alloy;

b. firing the bullet from the firearm, wherein the ignition of the smokeless gun powder by a firing mechanism causes a rapid expansion of gases within the brass casing;

c. propelling the nozzled projectile through the barrel of the firearm, wherein the plastic wad seals the gases and directs them towards the nozzled projectile;

d. allowing air to enter the hollow nozzled projectile at a proximal end and pass through the internal tapered structure, creating a venturi effect that enhances the kinetic energy and stability of the bullet during flight;

e. maintaining the bullet's trajectory and stability through an aerodynamically optimized shape of the nozzled projectile; and f. achieving maximized penetration upon impact with the target, facilitated by the external ballistic tip at a distal end of the nozzled projectile, and wherein the nozzled projectile has a point located adjacent to the proximal end which is wider in diameter than the proximal end, and wherein the nozzled projectile widens in diameter and is conically shaped from the point adjacent the proximal end to the distal end.

20. The method of claim 19, wherein the step of propelling the nozzled projectile through the barrel of the firearm includes achieving a muzzle velocity that optimizes the venturi effect created within the nozzled projectile.

* * * * *